United States Patent [19]

Highberger

[11] Patent Number: 4,536,032

[45] Date of Patent: Aug. 20, 1985

[54] BODY SUPPORT

[76] Inventor: Samuel M. Highberger, 5543 Westwood La., Birmingham, Mich. 48010

[21] Appl. No.: 528,798

[22] Filed: Sep. 1, 1983

[51] Int. Cl.[3] ..... A47C 9/12

[52] U.S. Cl. ..... 297/439; 5/419; 5/432; 5/443; 297/118

[58] Field of Search ..... 297/439, 438, 118; 5/432, 433, 443, 444, 419, 417

[56] References Cited

U.S. PATENT DOCUMENTS

| | | | |
|---|---|---|---|
| 322,792 | 7/1885 | Clark | 297/439 |
| 2,304,700 | 12/1942 | Manville | 5/419 |
| 2,816,599 | 12/1957 | Adams | 5/419 X |
| 3,264,033 | 8/1966 | Hansberg | 297/438 |
| 3,822,424 | 7/1974 | Messer | 5/419 |

FOREIGN PATENT DOCUMENTS

| | | | |
|---|---|---|---|
| 310300 | 4/1929 | United Kingdom | 297/439 |

*Primary Examiner*—James T. McCall
*Attorney, Agent, or Firm*—Edwin E. Greigg

[57] ABSTRACT

A body support and the method of making the same. The body support, whose function is to support a users legs, feet or head, includes three main parts connected together on a common pivot axis and which are swingable between a folded storage position, in which the three parts lie substantially in a common plane and an operative position in which two of the members form an inverted "V" shaped support for the third member which serves as the foot or head rest. The two members are "U" shaped with one of the members nesting within the other when the body support is in its folded position. The third member which may be cushioned is supported jointly by the pivot means and by a portion thereof resting on the legs of one of the "U" shaped members. The third member is inclined at an angle to serve as the foot or head support. The three parts can be made from a single piece of material. Means are provided to limit extension of the "U" shaped parts. A separate cushion means adapted to rest jointly on the floor and one of the "U" shaped parts serves to support the back of a user when the body support is used as a headrest.

6 Claims, 6 Drawing Figures

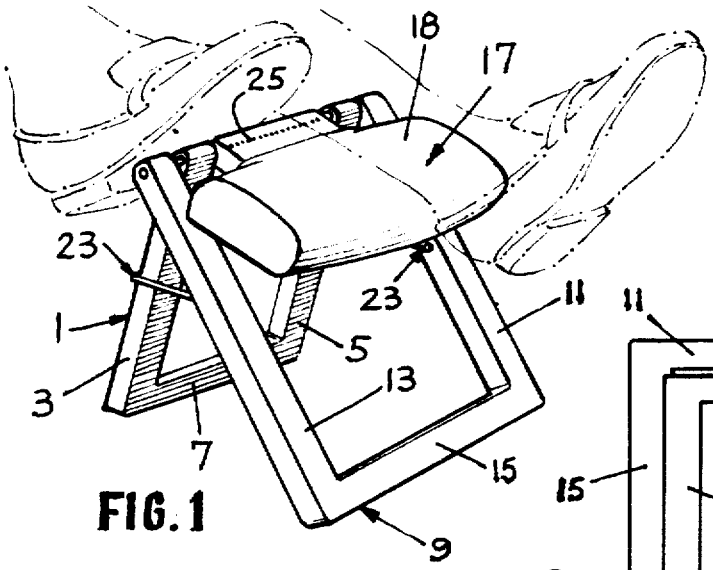
FIG. 1
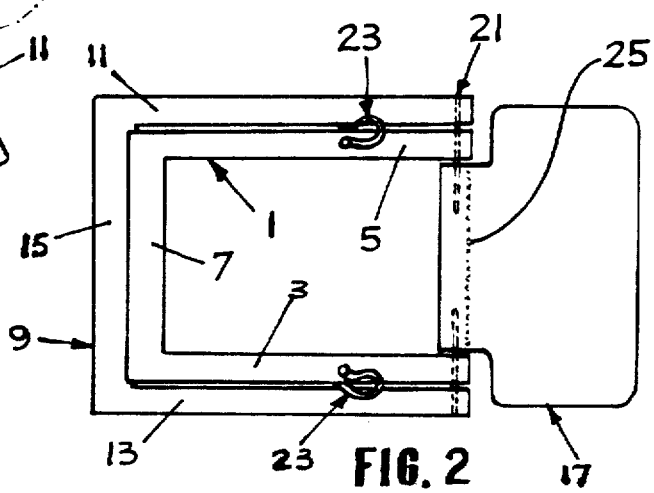
FIG. 2
FIG. 3
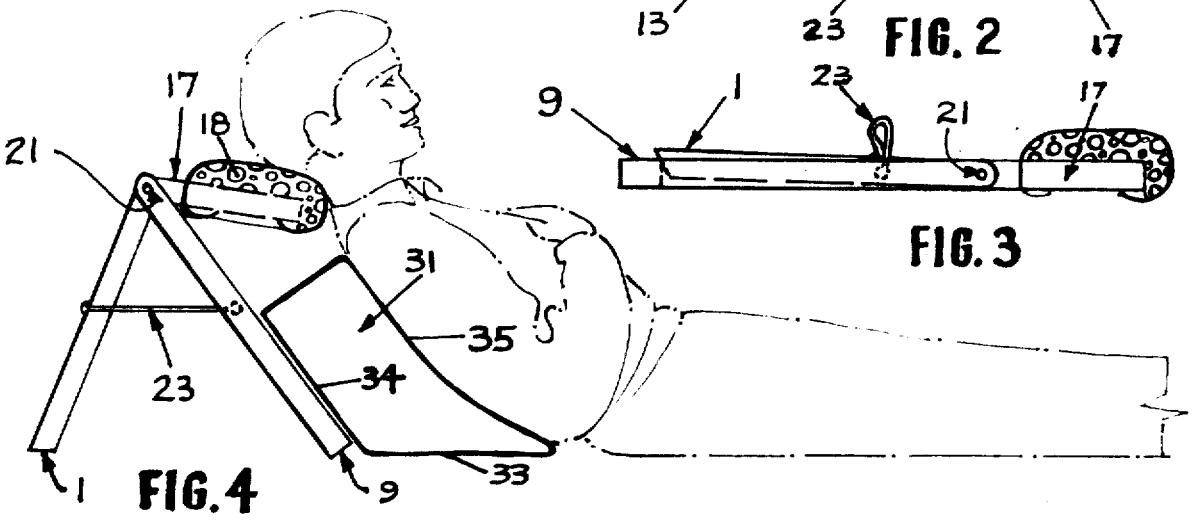
FIG. 4
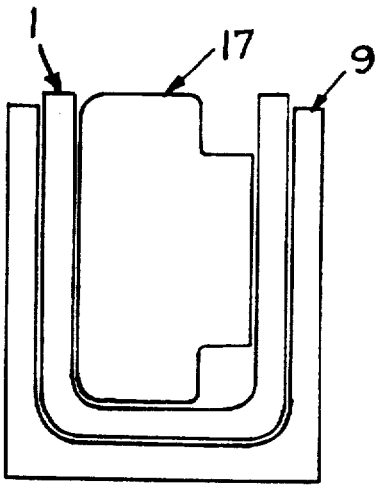
FIG. 5
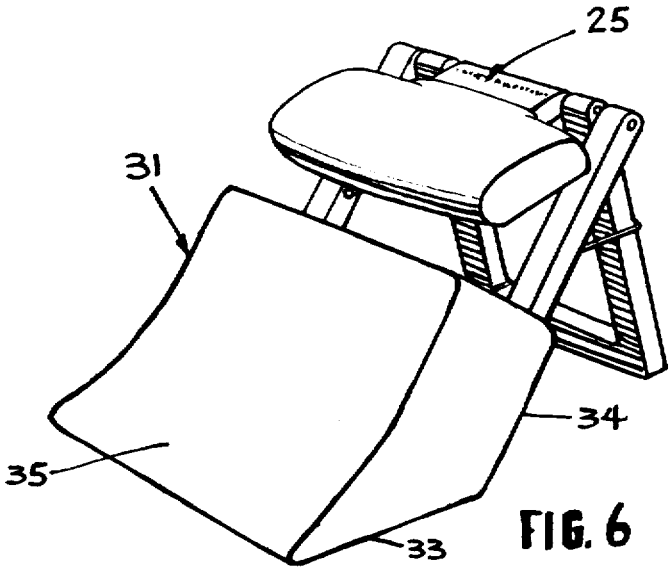
FIG. 6

BODY SUPPORT

TECHNICAL FIELD

This invention relates to body supports such as foot or head rests and particularly to a foldable leg or head rest which can be economically constructed, is easy to assemble and can be stored in a compact space.

BACKGROUND ART

U.S. Pat. No. 792,644 discloses a leg rest having a hinged support portion and a foot rest hinged to the support portion and also supported by a brace. When folded the foot rest thickness is the total thickness of the two support portions and the foot rest.

U.S. Pat. No. 3,371,962 also discloses a foot rest formed of three basic pieces including a pair of hinged support portions hinged on one axis and a foot support portion hinged to the main support on a different axis. This device is similar to that shown in U.S. Pat. No. 792,644 in that the various parts of the device are non-nestable and when folded do not fit into a very compact space.

U.S. Pat. No. 322,792 shows a foot rest having a plurality of parts including pairs of support legs pivoted together and to a leg support on a common axis. The leg support is freely swingable between the support legs. Pivotable movement of the support is limited only in one direction by a chain or cord means. No means are shown to limit the pivotable movement of the leg support to a vertical folded position when swung up to its operative relatively horizontal position. The user must raise the support with his hands or foot to the operative postion and hold it there with the weight of his foot or feet. Removal of the foot or feet will allow the leg support to fall to a nonoperative position.

The above examples are only a few of the many different types of the foldable foot and head rests that have been proposed. A foldable body support such as a foot or head rest has obvious advantages in that it can be stored in a relatively small space out of sight and out of the way. If the device is made from a relatively expensive material such as hardwood, it is important that the least amount of material be wasted. The body support should be easy to open to an operative position and back to a folded storable postion.

SUMMARY OF THE INVENTION

The present invention provides for three main members that are hinged on a common pivot. The three members can be formed from a single piece of material with a minimum of waste and manufacturing steps. The room required for storage of the body support is an absolute minimum. The device is strong enough for its purpose, eg. supporting one or more feet or legs or the head, yet is arranged to discourage its use for other purposes such as sitting or standing on the device.

BRIEF DESCRIPTION OF THE DRAWINGS

FIG. 1 is a perspective view of one form of the body support constructed according to the invention and illustrating the body support in its operative position supporting a users foot.

FIG. 2 is an elevational view of the device of FIG. 1 in a folded position.

FIG. 3 is a an end view of the foot rest of FIG. 1 also in its folded position.

FIG. 4 is a side view of the invention shown in its unfolded operative position and being used as a head rest in combination with a back support member.

FIG. 5 is a view of the invention after cutting the three main members or pieces from a single piece of material and prior to assembly and showing the three nested members.

FIG. 6 is a perspective view of the invention in combination with a back rest.

DISCLOSURE

Referring to the figures and particularly FIGS. 1 to 4, it will be seen that the subject body rest includes a first inner "U" shaped member, generally indicated 1 and which includes a pair of legs 3 and 5 connected by a bottom cross member 7. A second outer "U" shaped member, generally indicated 9, also includes a pair of leg members 11 and 13 connected together by a bottom crosspiece 15.

A third foot support member 17 comprises a generally rectangular piece having a relatively wide portion and a narrower portion. As seen in the figures, the narrow portion of member 17 fits within and between the legs 3 and 5 of the intermediate member 9. The member 17 can be covered with a cushion or pad 18 for comfort.

The three members 1, 9 and 17 are connected together for free pivotal movement on a common axis by means of pins or rods 21.

When the support members 1 and 9 are pivoted into a "V" position as shown in FIGS. 1 and 4, the foot support member 17 is in turn supported by the pin 21 and the outer ends of the wide portion of the member 17 resting on the upper portions of the legs 11 and 13. A cord or other flexible member 23 connects members 1 and 9 and limits the pivotable movement between them to the angle shown in FIGS. 1 and 4.

It should be seen that the inner "U" shaped member 1 is shorter than the outer "U" shaped member 9. In order that the user not open the body rest with the shorter member extending forward, in which case the device could tip forward, the pivot holes in these members are formed so that the cross piece 7 of member 1 extends slightly over the cross piece 15 of the outer member 9 as seen in FIGS. 2 and 3.

It will also be seen that the body support member, when in its operative position, does not extend fully parallel to the bottom of the legs but is inclined somewhat downward. This serves a double purpose, first it is a more natural resting position for the legs or head of the user, and secondly it discourages the use of the device as a sitting stool or device on which to stand. These uses could possibly cause collapse of the device and possibly cause injury to the user if sufficient weight were placed on the foot rest or head causing it to collapse.

The relatively thin and weak cord member 23 also discourages the user from putting all of his weight on the stool as by sitting or standing on the same. The three main members of the foot or head rest can be manufactured from a piece of material no larger than the outside deminsions of the outer "U" shaped support member 1. FIG. 5 shows how the three parts can be formed by just two cuts in a generally square piece of material such a wood or other material.

The device is easily folded into the position shown in FIGS. 2 and 3 wherein the three parts lie substantially in a common plane and will fit under a very low piece of furniture for storage. As shown, the U-shaped member 1 fits within the U-shaped member 9 with the cross-piece 7 extending slightly over the cross piece 15. The foot support member 17 extends beyond the U-shape members 1 and 9 so that the foot support members 17 is in substantially the same plane as the U-shaped members 1 and 9. The padding 18 not numbered in FIG. 3 is clearly shown in FIGS. 3 and 4.

While the preferred embodiment of the invention comprises the three main members made from of the same piece of material, it is obvious that they can also be made by joining together smaller parts to form the two "U" shaped members 1 and 9 and the support member 17. Also the parts could be made from molded plastic or other material.

The top of the leg support member 17 may be padded or cushioned as shown at 18, however the narrow part of the member 17 which carries a warning 25 such as "Do Not Stand or Sit Upon" should not be covered.

The invention can be used either as a foot rest as shown in FIG. 1 or as a head rest as shown in FIG. 4. Where used as a head rest, a separate specially formed back support member 31 is placed on the floor in front of the body support device. The back support member 31 has a flat bottom 33 that lies on the floor, an inclined rear portion 34 that engages the front "U" shaped member 9 of the body support which is functioning as a head rest. The back support member 31 further has a body conforming front 35 that carries the weight of the user as shown in FIG. 4.

The back support portion may be formed of any suitable cushion material such as foam or the such. It further may be covered with a decorative material that matches the covering material of the cushion on member 17.

I claim:

1. A foldable bodyrest comprising three main parts hinged together on a common connecting axis, the three parts when pivoted into a folded position lie substantially in a common plane, the first and second of the parts each having a pair of leg members connected together by a cross member to form a pair of "U" shaped members, one of the "U" shaped members forming an intermediate part having an outside dimension between its legs less than the inside dimension between the legs of the other "U" shaped member which forms an outer part and whereby the intermediate part can fit within the outer part, the third of the parts having a partial rectangular shape forming a body support and having a first narrow portion having a dimension less than the inside dimension between the legs of the intermediate part and a relatively wide portion having a dimension greater than the inside dimension between the legs of the intermediate part, and pivot means extending through the outer ends of the legs of the "U" shaped parts and through the narrow portion of the third part to form the common connecting axis, said "U" shaped members forming an inverted "V" support adapted to rest on the floor when swung on the pivot axis, said third member supported in a generally horizontal position by the pivot means and by the wide portion of the third member resting on the legs of one of the "U" shaped members.

2. The bodyrest of claim 1 wherein means connect the "U" shaped members and acts to limit the pivotable extension thereof in one direction.

3. The bodyrest of claim 1 wherein the third foot support member is supported to incline downwards at an angle to a true horizontal position.

4. The bodyrest of claim 1 wherein when the bodyrest is in its folded condition, the cross piece of the intermediate member extends slightly beyond the inner edge of the cross piece of the outer "U" shaped member whereby interference between the cross pieces prevents pivotal extension in one direction.

5. The method of making the bodyrest of claim 1 where a single piece of material is cut by two "U" cuts from one side to form three nesting parts, an outer part, an intermediate part and an innermost part, the outer part forming an outer "U" shaped part of the footrest, the intermediate part forming an inner "U" shaped part, and the innermost part forming a foot support member, drilling holes through the ends of the legs of the "U" shaped parts, cutting away a portion at two of the corners of the third part to form a narrow portion thereof, drilling a hole through the narrow portion, assembling the three parts into a nested arrangement with all of the holes aligned to form a common axis, and inserting a pivot pin through the holes to form a pivot means and to assemble the three nesting parts together.

6. A combination head and back rest including a foldable first device having a pair of support members forming an inverted "V" support for a downwardly inclined head support supported by a facial surface one of said support members and a formed back support member having a rear face lying against a front side of one of the pair of support members, a bottom face adapted to rest on the floor and a front inclined face adapted to support the back of a user.

* * * * *